US006676715B2

(12) United States Patent
Henry et al.

(10) Patent No.: US 6,676,715 B2
(45) Date of Patent: Jan. 13, 2004

(54) DIESEL FUEL STABILIZER

(75) Inventors: Cyrus Pershing Henry, Wilmington, DE (US); Barbara Elizabeth Goodrich, Newark, DE (US)

(73) Assignees: The Associated Octel Company Limited, Manchester (GB); Octel Starreon, LLC, Newark, DE (US)

( * ) Notice: Subject to any disclaimer, the term of this patent is extended or adjusted under 35 U.S.C. 154(b) by 175 days.

(21) Appl. No.: 09/854,270

(22) Filed: May 11, 2001

(65) Prior Publication Data

US 2002/0026743 A1 Mar. 7, 2002

Related U.S. Application Data

(60) Provisional application No. 60/203,870, filed on May 12, 2000.

(51) Int. Cl.[7] ..... C10L 1/18; C10L 1/22

(52) U.S. Cl. ..... 44/329; 44/331; 44/332; 44/333; 44/334; 44/335; 44/336; 44/338; 44/339; 44/340; 44/341; 44/343; 44/346; 44/347; 44/349; 44/350; 44/351; 44/352; 44/353

(58) Field of Search ..... 44/331, 347, 329, 44/332, 333, 334, 335, 336, 338, 339, 340, 341, 343, 346, 349, 350, 351, 352, 353

(56) References Cited

U.S. PATENT DOCUMENTS

| | | | | | |
|---|---|---|---|---|---|
| 4,405,333 | A | | 9/1983 | Seemuth | |
| 4,457,763 | A | | 7/1984 | Seemuth | |
| 4,482,353 | A | | 11/1984 | Hanlon | |
| 4,482,356 | A | | 11/1984 | Hanlon | |
| 4,482,357 | A | | 11/1984 | Hanlon | |
| 4,553,979 | A | | 11/1985 | Hanlon et al. | |
| 4,588,415 | A | | 5/1986 | Zaweski et al. | |
| 4,632,674 | A | * | 12/1986 | Martella | 44/343 |
| 5,405,417 | A | | 4/1995 | Cunningham | |
| 5,752,989 | A | * | 5/1998 | Henly | 44/347 |
| 5,916,825 | A | * | 6/1999 | Cherpeck | 44/437 |
| 6,033,446 | A | * | 3/2000 | Cherpeck | 44/340 |
| 6,051,039 | A | * | 4/2000 | Sugimoto | 44/341 |

FOREIGN PATENT DOCUMENTS

| | | |
|---|---|---|
| EP | 0 457 589 A1 | 11/1991 |

* cited by examiner

*Primary Examiner*—Cephia D. Toomer
(74) *Attorney, Agent, or Firm*—Fay, Sharpe, Fagan, Minnich & McKee, LLP

(57) ABSTRACT

There is provided use of a thermal stabiliser for increasing the thermal stability of a cetane improver in a fuel composition comprising (i) a fuel, and (ii) the cetane improver wherein the thermal stabiliser is a compound of the formula $$H—R^1$$

wherein H is a group comprising a heterocyclic group and $R^1$ is a hydrocarbyl group having from 10 to 200 carbons.

49 Claims, No Drawings

DIESEL FUEL STABILIZER

This application is a continuation of U.S. Provisional Application No. 60/203,870, filed on May 12, 2000.

The present invention relates to a diesel fuel stabiliser. In particular the present invention relates to a stabiliser for a diesel fuel containing a cetane improver.

As discussed in U.S. Pat. No. 5,482,518 fuel ignition in diesel engines is achieved through the heat generated by air compression, as a piston in the cylinder moves to reduce the cylinder volume during the compression stroke. In the engine, the air is first compressed, then the fuel is injected into the cylinder; as the fuel contacts the heated air, it vaporises and finally begins to burn as the self-ignition temperature is reached. Additional fuel is injected during the compression stroke and the fuel burns almost instantaneously, once the initial flame has been established. Thus, a period of time elapses between the beginning of fuel injection and the appearance of a flame in the cylinder. This period is commonly called "ignition delay" and must be relatively short in order to avoid "diesel knock".

A major contributing factor to diesel fuel performance and the avoidance of "diesel knock" is the cetane number of the diesel fuel. Diesel fuels of higher cetane number exhibit a shorter ignition delay than do diesel fuels of a lower cetane number. Therefore, higher cetane number diesel fuels are desirable to avoid diesel knock. Most diesel fuels possess cetane numbers in the range of about 40 to 55 and a sulfur content of about 500 ppm and less. A correlation between ignition delay and cetane number has been reported in "How Do Diesel Fuel Ignition Improvers Work" Clothier, et al., Chem. Soc. Rev, 1993, pg. 101–108.

Cetane improvers have been used for many years to improve the ignition quality of diesel fuels. The use of cetane improvers is increasing due to the increased demand for diesel fuel which has resulted in a widening of the fraction recovered, the so called middle distillate fraction, and the lower natural cetane number of diesel base stocks caused by more severe refining of crude oil and the effort made to produce low emission diesel.

Many types of additives have been prepared and evaluated to raise the cetane number of diesel fuel. Such additives include peroxides, nitrates, nitrites, azo compounds and the like.

Alkyl nitrates such as amyl nitrate, hexyl nitrate and mixed octyl nitrates have been used commercially with good results. Other nitrates such as 2-methyl-2-nitropropyl nitrate (U.S. Pat. No. 4,536,190) have been suggested as cetane improvers but found shock sensitive. However, it is generally accepted that organic nitrates, more specifically the commercial 2-ethylhexyl nitrate, are the most cost-effective additives to improve cetane number of diesels. 2-ethylhexyl nitrate is available from the Associated Octel Company Limited under the brand name Cl-0801.

It is known that 2-ethylhexyl nitrate (2-EHN) has a de-stabilising effect on many diesel fuels when subjected to high temperature test conditions, such as ASTM D6468-99, Standard Test Method for High Temperature Stability of Distillate fuels. D6468 is a test that involves aging fuel for 90 or 180 minutes at a temperature of 150° C. This is a temperature above the auto-decomposition temperature of cetane improvers such as 2-EHN, and the decomposition products promote instability of diesel fuels.

Recent data by Bacha, et al. have demonstrated that high temperature stability as measured in D6468 is related to on-road performance of diesel trucks. Because of these findings, the National Council of Weights and Measures has chosen to specify test results developed from ASTM D6468 as a partial basis for defining "premium" diesel fuel in the United States. There is therefore a desire to overcome the problems of diesel destabilisation by cetane improvers, in particular by 2-EHN.

The prior art has provided some additives which are normally used to improve storage stability and will give some improvement in ASTM D6468. EP-A-0947577 teaches tertiary alkyl primary amines may stabilise diesel fuel containing cetane number improver.

The present invention alleviates the problems of the prior art

In a one aspect the present invention provides use of a thermal stabiliser for increasing the thermal stability of a cetane improver in a fuel composition comprising (i) a fuel, and (ii) the cetane improver, wherein the thermal stabiliser is a compound of the formula H—$R^1$ wherein H is a group comprising a heterocyclic group and $R^1$ is a hydrocarbyl group having from 10 to 200 carbons.

In a further aspect the present invention provides a fuel composition comprising (i) a fuel (ii) a cetane improver (iii) a thermal stabiliser, wherein the thermal stabiliser is a compound of the formula H—$R^1$ wherein H is a group comprising a heterocyclic group and $R^1$ is a hydrocarbyl group having from 10 to 200 carbon.

The present inventors have found that compounds such as those defined in the present claims, for example polyisobutenyl succinimide (PIBSI), are surprisingly effective in stabilising cetane improvers in diesel fuel. In particular the present compounds are effective in reducing the thermal degradation of cetane improvers such as 2-EHN.

The present inventors have found and have demonstrated in the attached examples that the present thermal stabilisers such as PIBSI effectively stabilise cetane improvers in diesel and in some aspects are provide improved stabilisation when compared to the stabilisers of the prior art, for example the stabilisers of EP-A-0947577.

Furthermore, in aspects of the invention, for example when PIBSI is used as a stabiliser, the thermal stabiliser has a further functionality—it is an effective detergent to improve injector cleanliness, for example in an L-10 Cummins diesel engine (a test is commonly used in the USA) and other diesel engine detergency tests.

FURTHER ASPECTS

In the present specification by the term "hydrocarbyl group" it is meant a group comprising at least C and H and may optionally comprise one or more other suitable substituents. Examples of such substituents may include halo-, alkoxy-, nitro-, a hydrocarbon group, an N-acyl group, a cyclic group etc. In addition to the possibility of the substituents being a cyclic group, a combination of substituents may form a cyclic group. If the hydrocarbyl group comprises more than one C then those carbons need not necessarily be linked to each other. For example, at least two of the carbons may be linked via a suitable element or group. Thus, the hydrocarbyl group may contain hetero atoms. Suitable hetero atoms will be apparent to those skilled in the art and include, for instance, sulphur, nitrogen and oxygen.

Thermal Stabiliser

R1 Group

Preferably $R^1$ is a branched or straight chain alkyl group. Preferably $R^1$ is a branched alkyl group.

$R^1$ may be a $C_{10}$–$C_{200}$ hydrocarbon group. $R_1$ is preferably a $C_{30}$–$C_{80}$ group and more preferably a polyisobutene (PIB).

Conventional PIBs and so-called "high-reactivity" PIBs (see for example EP-A-0 565 285) are suitable for use in the invention. High reactivity in this context is defined as a PIB wherein at least 50%, preferably 70% or more, of the terminal olefinic double bonds are of the vinylidene type, for example the GLISSOPAL compounds available from BASF.

Preferably $R^1$ has a molecular weight of from 200 to 2000, more preferably 260 to 1000, for example about 260, 320, 350, 550, 750, 780 or 1000, more preferably from 750 to 780.

Preferably $R^1$ is a PIB having a molecular weight of from 200 to 2000, more preferably 260 to 1000, for example about 260, 320, 350, 550, 750, 780 or 1000, more preferably from 750 to 780.

H—Heterocyclic Group

Preferably the heterocyclic group is a hydrocarbyl ring at least one member of which is selected from N, S and O. The ring portion of such a ring is referred to as a heterocyclic ring. Preferably at least one member of the hydrocarbyl ring is N.

Preferably the heterocyclic ring has from 4 to 10 members, more preferably from 4 to 6 members, yet more preferably 5 members.

Preferably the heterocyclic ring is substituted. Preferably the heterocyclic ring is substituted with one or more=O groups.

Preferably the heterocyclic ring is of the formula

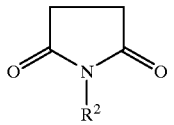

$R^2$ may be selected from hydrogen, C1–20 straight, branched or substituted alkyl, or polyamine. The alkyl may be methyl, ethyl, butyl. The polyamine may be ethylenediamine, diethylenetriamine, triethylenetetraamine, tetraethylenepentaamine, pentaethylenehexamine, dimethylaminopropylamine, aminoethylethanolamine, and other commercially available materials which comprise complex mixtures of polyamines.

Preferably the heterocyclic group comprises linker via which the heterocyclic ring is attached to $R^1$. Preferably the linker group is a $C_{1-5}$ alkyl group, more preferably a $C_{1-3}$ alkyl group, yet more preferably a $—CH_2—$ group.

Preferably $N—R^2$ is a residue of a long chain polyalkylenepolyamine.

Stabiliser $H—R^1$

The compound $H—R^1$ may in the form of a "dimer" or may capped with a further H group. Thus in one aspect the compound $H—R^1$ may be present in the form of a compound of the formula $H—R^1—R^1—H$ or $H—R^1—H$. In further aspects, the thermal stabilser Preferably the thermal stabiliser is polyisobutene succinimide monotetraethylene pentaamine. More preferably the thermal stabiliser is polyisobutene succinimide monotetraethylene pentaamine having a PIB molecular weight of from 200 to 2000, more preferably 260 to 1000, for example about 260, 320, 350, 550, 750, 780 or 1000, more preferably from 750 to 780. In a highly preferred embodiment the thermal stabiliser is 780-polyisobutene succinimide monotetraethylene pentaamine.

Cetane Improver

Preferably the cetane improver is 2-ethylhexyl nitrate.

Fuel

Preferably the fuel is a diesel fuel

Composition

The thermal stabiliser compound of the present invention can be combined with other additives to give other improvements, in an additive package/thermal stabiliser composition. The thermal stabiliser composition may comprise, in addition to the thermal stabiliser, antihaze additives, 2-EHN, corrosion inhibitors, lubricity improvers, cold flow improvers, or icing inhibitors.

In one aspect the thermal stabiliser composition may comprise a mixture of compounds of the formula $H—R^1$, $H—R^1—R^1—H$ and/or $H—R^1—H$. In this aspect, preferably the $R^1$:H ratio in the composition is 1–1.5:1 or 1–1.2:1 or approximately 1:1

The present invention will now be described in further detail in the following examples.

EXAMPLES

In the attached examples and tabulated data, a reflection rating is obtained from a filter paper after aged fuel is filtered under standard conditions. The reflection rating is a relative indication of the amount of sediment formed in the fuel after aging at 150° C. A rating of 100 is the highest rating and shows that no sediment was formed under the test conditions. High reflection values (80–100) indicate satisfactory fuel. Values less than 80 have decreasing stability, and values under 50 can be considered poor.

Example 1

A number of tests were performed. In each test a fuel composition containing (i) low Sulphur Diesel, (ii) 2-EHN and (iii) additive was aged in accordance with D6468 at 150° C. for 180 minutes All samples contained 0.15 volume percent 2-EHN. Data in Table 1 shows results for a number of thermal stabilisers. These are

| | |
|---|---|
| FOA-81- | 780 - polyisobutene succinimide monotetraethylene pentaamine (–60%), Shellsol AB (–40%) + dehazer (<2%) |
| FOA-3- | N,N-dimethylcyclohexylamine |
| FOA-6- | organic amines in kerosene solvent |
| FOA-5- | methacrylate polymer in xylene |
| FOA-15- | methacrylate polymer, FOA3, metal deactivator + corrosion inhibitor |
| FOA-35A- | FOA3, FOA5, metal deactivator + corrosion inhibitor |
| Nalco 5300 - | organic amine stabiliser |

Each of FOA-3, FOA-6, FOA-5, FOA-15, FOA-35A, and Nalco 5300 are premier stabilising additives to improve stability of diesel fuels. Each of FOA-3, FOA-6, FOA-5, FOA-15, and FOA-35A are available from Associated Octel Company Limited. Nalco 5300 is available from Nalco Chemical Company.

TABLE I

| | Additive | | D1500 Color | | % Reflection |
|---|---|---|---|---|---|
| Sample ID | Type | Conc. Ptb | Initial | Final | Y green filter |
| P97-1297 | None | — | L1.5 | 5.0 | 42 |
| | N5300 | 10 | | L5.0 | 43 |
| | | 20 | | L5.0 | 46 |
| | FOA-5 | 10 | | L6.0 | 46 |
| | | 20 | | L6.5 | 53 |
| | FOA-6 | 10 | | L5.0 | 56 |
| | FOA-81 | 15 | | L6.5 | 77 |
| | | 30 | | L6.0 | 89 |
| | FOA-15 | 25 | | L6.0 | 66 |
| | FOA-35A | 25 | | L6.0 | 69 |
| P98-1025 | None | — | L1.5 | L5.5 | 23 |
| | N5300 | 10 | | L5.5 | 33 |
| | | 20 | | L4.5 | 36 |
| | FOA-5 | 10 | | L5.5 | 34 |
| | | 20 | | L6.0 | 36 |
| | FOA-6 | 10 | | L5.0 | 31 |
| | FOA-81 | 15 | | L5.5 | 74 |
| | | 30 | | L6.5 | 88 |
| | FOA-15 | 25 | | L5.5 | 68 |
| | FOA-35A | 25 | | 6.0 | 68 |

TABLE I-continued

| | Additive | | D1500 Color | | % Reflection |
|---|---|---|---|---|---|
| Sample ID | Type | Conc. Ptb | Initial | Final | Y green filter |
| P97-942 | None | — | L1.5 | L3.0 | 91 |
| | N5300 | 10 | | L3.0 | 92 |
| | | 20 | | L2.5 | 91 |
| | FOA-5 | 10 | | L3.0 | 95 |
| | | 20 | | L3.0 | 95 |
| | FOA-6 | 10 | | L2.5 | 93 |
| | FOA-81 | 15 | | L2.5 | 98 |
| | | 30 | | L2.5 | 98 |
| | FOA-15 | 25 | | L3.0 | 97 |
| | FOA-35A | 25 | | L2.5 | 98 |
| P97-296A | None | — | L0.5 | L4.5 | 50 |
| | N5300 | 10 | | L5.0 | 47 |
| | | 20 | | L4.5 | 52 |
| | FOA-5 | 10 | | L5.0 | 42 |
| | | 20 | | L6.0 | 48 |
| | FOA-6 | 10 | | L5.0 | 55 |
| | FOA-81 | 15 | | L6.0 | 67 |
| | | 30 | | L5.0 | 88 |
| | FOA-15 | 25 | | L4.0 | 81 |
| | FOA-35A | 25 | | L5.0 | 85 |

These data show that FOA-81 (shown in bold in the table) is far more effective in improving the filter reflection rating than the other materials tested Example 2

A number of tests were performed. In test related to a low sulphur diesel fuel. Samples comprised (i) base fuel containing no cetane improver or thermal stabiliser—control, (ii) base fuel and 2-EHN, and (iii) base fuel, 2-EHN and given additive. When present, 2-EHN was supplied by Associated Octel Company Limited under the brand name Cl-0801 and was present in an amount of 0.15 volume percent.

Data in Table 2 shows results for a number of thermal stabilisers. These are

FOA-81–780-polyisobutene succinimide monotetraethylene pentaamine

Primene 81-R-tertiary alkyl primary amine of the formula $(C_{12-14})_3CNH_2$

Primene JM-T-tertiary alkyl primary amine of the formula $(C_{16-22})_3CNH_2$

Primene 81-R and Primene JM-T are available from Rohm and Haas.

TABLE 2

| | Additive | | D1500 Colour | | % Reflection |
|---|---|---|---|---|---|
| Fuel ID | Type | Conc. ptb | Initial | Final | Y |
| P99-262 | Control | 0 | L1.5 | L3.0 | 82 |
| | (CI-0801 only) | 0 | | L7.5 | 38 |
| | FOA-81 + CI-0801 | 30 | | L7.0 | 78 |
| | Primene 81-R + CI-0801 | 30 | | L4.5 | 36 |
| | Primene JM-T + CI-0801 | 30 | | L5.5 | 56 |
| P99-575 | Control | 0 | L1.0 | L2.5 | 88 |
| | (CI-0801 only) | 0 | | L6.0 | 47 |
| | FOA-81 + CI-0801 | 10 | | L4.5 | 90 |
| | Primene 81-R + CI-0801 | 10 | | L5.0 | 62 |
| | Primene JM-T + CI-0801 | 10 | | L5.0 | 56 |

TABLE 2-continued

| | Additive | | D1500 Colour | | % Reflection |
|---|---|---|---|---|---|
| Fuel ID | Type | Conc. ptb | Initial | Final | Y |
| P99-643 | Control | 0 | L1.5 | L2.5 | 92 |
| | (CI-0801 only) | 0 | | L5.5 | 54 |
| | FOA-81 + CI-0801 | 10 | | L4.5 | 80 |
| | Primene 81-R + CI-0801 | 10 | | L5.0 | 67 |
| | Primene JM-T + CI-0801 | 10 | | L5.0 | 76 |
| P99-644 | Control | 0 | L1.5 | L2.5 | 83 |
| | (CI-0801 only) | 0 | | L5.5 | 70 |
| | FOA-81 + CI-0801 | 10 | | 5.5 | 92 |
| | Primene 81-R + CI-0801 | 10 | | L4.5 | 86 |
| | Primene JM-T + CI-0801 | 10 | | L5.0 | 83 |

These data show that FOA-81 (shown in bold in the table) is far more effective in improving the filter reflection rating than the other materials tested All publications mentioned in the above specification are herein incorporated by reference. Various modifications and variations of the described methods and system of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in chemistry or related fields are intended to be within the scope of the following claims.

What is claimed is:

1. A process for increasing the thermal stability of a cetane improver in a fuel composition comprising (i) a fuel, and (ii) the cetane improver comprising the step of contacting the fuel composition with thermal stabilizer compound of the formula $$H—R^1—H$$

wherein H is a group comprising a heterocyclic group and $R^1$ is a hydrocarbyl group having from 10 to 200 carbons.

2. A fuel composition comprising (i) a fuel (ii) a cetane improver (iii) a thermal stabilizer, wherein the thermal stabilize is a compound of the formula $$H—R^1—H$$

wherein H is a group comprising a heterocyclic group and $R^1$ is a hydrocarbyl group having from 10 to 200 carbon.

3. A thermal stabilizer for increasing the thermal stability of a cetane improver in a fuel composition comprising (i) a fuel, and (ii) the cetane improver wherein the thermal stabilizer is a compound of the formula $$H—R^1—H$$

wherein H is a group comprising a heterocyclic group and is a hydrocarbyl group having from 10 to 200 carbons.

4. The process of claim 1 wherein the $R^1$:H ratio in the composition is about 1–1.5:1.

5. The process of claim 1 wherein the fuel is a diesel fuel.

6. The process of claim 1 wherein the cetane improver is 2-ethylhexyl nitrate.

7. The process of claim 1 wherein $R^1$ is a branched or straight chain alkyl group.

8. The process of claim 7 wherein $R^1$ is a branched alkyl group.

9. The process of claim 7 wherein $R^1$ is polyisobutene.

10. The process of claim 1 wherein $R^1$ has a molecular weight of from about 750 to 780.

11. The process of claim 7 wherein $R^1$ is polyisobutene a molecular weight of from about 750 to 780.

12. The process of claim 7 wherein the heterocyclic group is a hydrocarbyl ring at least one member of which is selected from N, S and O.

13. The process of claim 1 wherein least one member of the hydrocarbyl group is N.

14. The process of claim 1 wherein the heterocyclic group has from 4 to 10 members.

15. The process of claim 14 wherein the heterocyclic group has from 4 to 6 members.

16. The process of claim 15 wherein the heterocyclic group has 5 members.

17. The process of claim 1 wherein the heterocyclic group is substituted.

18. The process of claim 17 wherein the heterocyclic group is substituted with one or more double bonded O groups.

19. The process of claim 1 wherein the heterocyclic group is of the formula

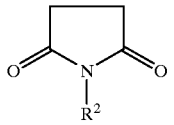

wherein $R^2$ is selected from the group consisting of hydrogen, $C_1$–$C_{20}$ straight alkyl, $C_1$–$C_{20}$ branched alkyl, $C_1$–$C_{20}$ substituted alkyl and polyamine.

20. The process of claim 19 wherein N—R2 is a residue of a polyalkylenepolyamine.

21. A process for increasing the thermal stability of a cetane improver in a fuel composition comprising (i) a fuel, and (ii) the cetane improver comprising the step of contacting the fuel composition with thermal stabilizer compound of the formula $$H—R^1—R^1—H$$

wherein H comprises a heterocyclic group and $R^1$ comprises hydrocarbyl group having from 10 to 200 carbons.

22. A fuel composition comprising (i) a fuel (ii) a cetane improver (iii) a thermal stabilizer, wherein the thermal stabilize is a compound of the formula $$H—R^1—R^1—H$$

wherein H comprises a heterocyclic group and $R^1$ comprises hydrocarbyl group having from 10 to 200 carbon.

23. A thermal stabilizer for increasing the thermal stability of a cetane improver in a fuel composition comprising (i) a fuel, and (ii) the cetane improver wherein the thermal stabilizer is a compound of the formula $$H—R^1—R^1—H$$

wherein H comprises a heterocyclic group and $R^1$ comprises hydrocarbyl group having from 10 to 200 carbons.

24. The process of claim 21 wherein the $R^1$:H ratio in the composition is about 1–1.5:1.

25. The process of claim 21 wherein the fuel is a diesel fuel.

26. The process of claim 21 wherein the cetane improver is 2-ethylhexyl nitrate.

27. The process of claim 21 wherein $R^1$ is a branched or straight chain alkyl group.

28. The process of claim 27 wherein $R^1$ is a branched alkyl group.

29. The process of claim 27 wherein $R^1$ is polyisobutene.

30. The process of claim 21 wherein $R^1$ has a molecular weight of from about 750 to 780.

31. The process of claim 27 werein $R^1$ is polyisobutene having a molecular weight of from about 750 to 780.

32. The process of claim 27 wherein the heterocyclic group is a hydrocarbyl ring having at least one member selected from N, S and O.

33. The process of claim 21 wherein at least one member of the hydrocarbyl group is N.

34. The process of claim 21 wherein the heterocyclic group has from 4 to 10 members.

35. The process of claim 34 wherein the heterocyclic group has from 4 to 6 members.

36. The process of claim 35 wherein the hetercyclic group has 5 members.

37. The process of claim 21 wherein the heterocyclic group is substituted.

38. The process of claim 37 wherein the heterocyclic group is substituted with one or more double bonded O groups.

39. The process of claim 21 wherein the heterocyclic group is of the formula

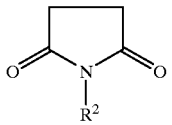

wherein $R^2$ is selected from the group consisting of hydrogen, $C_1$–$C_{20}$ straight alkyl, $C_{1-C20}$ branched alkyl, $C_1$–$C_{20}$ substituted alkyl and polyamine.

40. The process of claim 39 wherein N—R2 is a residue of a polyalkylenepolyamine.

41. A process for increasing the thermal stability of a cetane improver in a fuel composition comprising (i) a fuel, and (ii) the cetane improver comprising the step of contacting the fuel composition with thermal stabilizer comprising a blend of compounds having the formulas $$HR^1—H \text{ and } H—R^1$$

wherein H is a group comprising a heterocyclic group and $R^1$ is a hydrocarbyl group having from 10 to 200 carbons.

42. A fuel composition comprising (i) a fuel (ii) a cetane improver (iii) a thermal stabilizer, wherein the thermal stabilizer comprises a blend of compounds having the formulas $HR^1$—H and H—$R^1$ wherein H is a group comprising a heterocyclic group and $R^1$ is a hydrocarbyl group having from 10 to 200 carbon.

43. A thermal stabilizer for increasing the thermal stability of a cetane improver in a fuel composition comprising (i) a fuel, and (ii) the cetane improver wherein the thermal stabilizer comprises a blend of compounds having the formulas $HR^1$—H and H—$R^1$ wherein H is a group comprising a heterocyclic group and $R^1$ is a hydrocarbyl group having from 10 to 200 carbon.

44. The process of claim 41 wherein the heterocyclic group further includes is a $C_{1-6}$ alkyl linking group via which the heterocyclic group is attached to $R^1$.

45. The process of claim 44 wherein the linking group is a $C_{1-3}$ alkyl group.

46. The process of claim 44 wherein the linking group is a —$CH_2$— group.

47. The process of claim 41 wherein the thermal stabilizer comprises polyisobutene succinimide tetraethylene peptaamine.

48. The process of claim 1 wherein the $R^1$:H ratio in the composition is about 1:1.

49. The process of claim 21 wherein the $R^1$:H ratio in the composition is about 1:1.

* * * * *